United States Patent [19]

Wehr

[11] 4,387,542

[45] Jun. 14, 1983

[54] INTEGRATED WINDOW AND WALL SYSTEM

[75] Inventor: David M. Wehr, Sewickley, Pa.

[73] Assignee: Cyclops Corporation, Pittsburgh, Pa.

[21] Appl. No.: 140,454

[22] Filed: Apr. 17, 1980

[51] Int. Cl.[3] ..... E06B 7/14

[52] U.S. Cl. ..... 52/209; 52/235; 52/397; 52/455

[58] Field of Search ..... 52/209, 208, 207, 217, 52/213, 397, 398, 455; 49/408, 471, 505, DIG. 1, 235

[56] References Cited

U.S. PATENT DOCUMENTS

| | | | |
|---|---|---|---|
| 1,908,623 | 5/1933 | Barringer | 49/471 |
| 2,386,151 | 10/1945 | Trautvetter | 52/208 |
| 2,949,981 | 8/1960 | Ferrell | 52/235 |
| 2,985,263 | 5/1961 | Maciunas | 49/DIG. 1 |
| 3,093,217 | 6/1963 | Doede | 49/DIG. 1 |
| 3,184,801 | 5/1965 | Fletcher | 52/209 |
| 3,204,324 | 9/1965 | Nilsen | 49/DIG. 1 |
| 3,206,901 | 9/1965 | Bakke | 52/209 |
| 3,462,884 | 8/1969 | Bissoniere | 49/DIG. 1 |
| 3,466,826 | 9/1969 | Gallagher | 49/DIG. 1 |
| 3,468,064 | 9/1969 | Fraleigh | 49/DIG. 1 |
| 3,522,684 | 4/1970 | Grossman | 52/726 |
| 3,555,736 | 1/1971 | Roch | 52/208 |
| 3,640,557 | 2/1972 | Nate | 52/726 |
| 3,866,369 | 2/1975 | Paull | 52/209 |
| 4,015,388 | 4/1977 | Hemminger | 52/772 |
| 4,018,022 | 4/1977 | Fink | 49/DIG. 1 |
| 4,141,188 | 2/1979 | Sukolics | 52/772 |
| 4,214,415 | 7/1980 | Sukolics | 49/DIG. 1 |
| 4,276,729 | 7/1981 | Shiga | 52/209 |

FOREIGN PATENT DOCUMENTS

| | | | |
|---|---|---|---|
| 2019474 | 10/1979 | United Kingdom | 49/408 |

*Primary Examiner*—Price C. Faw, Jr.
*Assistant Examiner*—Henry E. Raduazo
*Attorney, Agent, or Firm*—William J. Ruano

[57] ABSTRACT

An integrated window and wall system for buildings, particularly industrial and commercial buildings, comprising ladder-like horizontally extending outer and inner metal members which clamp onto the bottom and top portions of insulating wall panels, and clamp onto window glazing units mounted in the openings of said ladder-like members. Extending across both longitudinal sides of the ladder-like metal members are substantially horizontal gutter and reinforcing flanges for draining water from the upper wall panels and from the lower edge of the window glazing units. The water drains through sponge-like baffles and through weep holes spaced along the outer longitudinal members. The exposed inner metal members are thermally isolated from the outer metal members. Glazing beads are provided for adjustably clamping between said outer and inner metal members, either single or double pane glass windows. The cross pieces of the ladder-like outer and inner metal members serve as vertical mullions between horizontally spaced glass glazing units.

13 Claims, 13 Drawing Figures

INTEGRATED WINDOW AND WALL SYSTEM

This invention relates to an integrated window and wall system for fabricating industrial, commercial and other types of buildings.

An outstanding disadvantage of many known types of window units is that the metal exposed to the interior is connected through metal parts to metallic exterior wall portions, thereby causing condensation on the interior metal.

Another disadvantage is that each window unit has a gutter to control only its leakage.

Still another disadvantage is that presently known systems are not readily adjustable to accomodate different thicknesses of glass, such as a single pane or a double pane glass window,—also such systems often require installation of windows from the outside of the building.

BRIEF SUMMARY OF THE INVENTION

An object of the present invention is to overcome the above-named disadvantages of conventional systems.

Another object of the present invention is to integrate single or double window units with a given insulated metal wall panel system.

A more specific object of the present invention is to provide an integrated window and wall system wherein interior exposed metal wall portions are thermally isolated from exterior exposed metal wall portions so as to prevent condensation on the interior metal wall portions.

Another specific object of the invention is to provide a head member which will handle leakage from the wall panel system above instead of being confined to drain its own window system.

Still another specific object is to provide a novel baffle and weep hole arrangement to eliminate the necessity of outer protective hoods.

Still another specific object of the invention is to provide an easy and quick adjustment to enable selective installation of either single pane or double pane windows accessible from the interior of the building.

Other objects and advantages of the invention will become more apparent from a study of the following specification taken with the accompanying drawings wherein:

DETAILED DESCRIPTION

Figure 1:
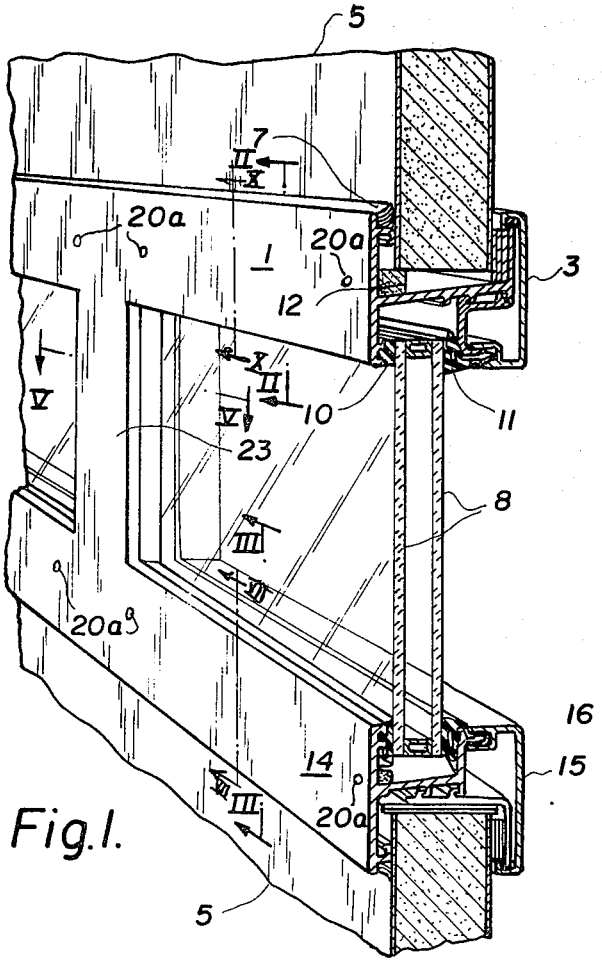
FIG. 1 is a perspective, fragmentary view, in vertical cross-section, of an integrated window and wall system embodying the principles of the present invention.
Figure 2:
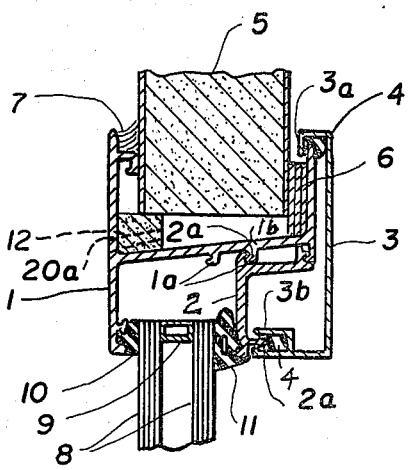
FIG. 2 is a somewhat enlarged, fragmentary cross-sectional view taken along line II—II of FIG. 1 showing the head portion of the window assembly.
Figure 3:
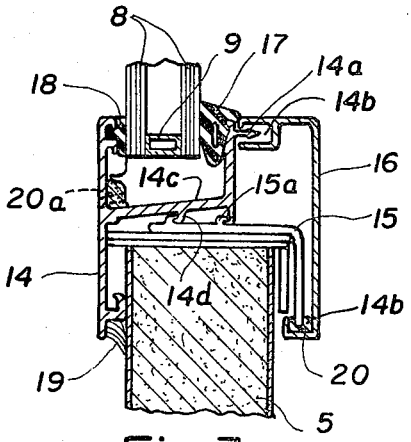
FIG. 3 is a somewhat enlarged, fragmentary, cross-sectional view taken along line III—III of FIG. 1 showing the sill portion of the wall and window construction.

Referring more particularly to FIGS. 1, 2 and 3 of the drawings, a ladder-like outer metal member preferably of extruded aluminum, comprises a head extrusion 1, a sill extrusion 14 and a mullion extrusion 23 formed as an integral piece. Only a fragmentary portion of the ladder-like member is illustrated. Spaced horizontally therefrom is a horizontally extending ladder-like inner metal member comprising a head trim 3, sill trim 16 and mullion trim 21, which member is in spaced confronting relationship with the outer metal member.

As shown in FIG. 2, the inner metal member head trim 3 is thermally isolated from the outer metal member by yieldable themal insulators 4, located in flange 3*a* and preferably in the form of a plurality of short, spaced neoprene strips wrapped about the edge of the inner flange of head extrusion 1 together with a plurality of short, spaced plastic pieces 4, preferably of polyvinylchloride, which snap onto arrowhead shaped projection 2*a* surrounded by flange 3*b*.

Figure 6:
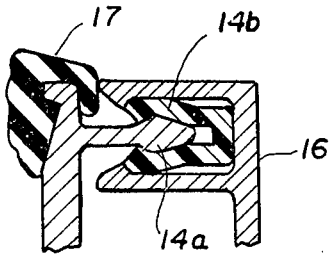
FIG. 6 is an enlarged, fragmentary cross-sectional view of a portion of FIGS. 1, and 3.

Likewise, as shown in FIG. 3, sill trim 16 is thermally isolated from the outer sill extrusion by yieldable thermal insulators 14*b*, preferably of neoprene wrapped about the outer edge of clip 15 together with projections 14*a* of arrowhead shape onto which plastic pieces 14*b* are snap-fitted inside trim 16 as more clearly shown in FIG. 6. Thus moisture in the air on the building will not condense on the exposed metal surfaces of the inner metal panels.

The top edge portion of window, 8, 8, as shown in FIG. 2, is thermally clamped between head extrusion 1 and glazing bead 2 by means of a glazing gasket strip 10, preferably of neoprene having molded corners, and neoprene wedge strip 11. The insulated panel 5, preferably of foam plastic material which has metal outer and inner surfaces, is sealed by silicone caulk 7 at the outside. Shims 6 are used to accomodate different thicknesses of panels 5 by clamping the inside of panel 5 in place. Glazing bead 2 has an upper projection which engages projection 2*a*. Baffle strips 12 of porous or spongy material, preferably urethane, are supported on the substantially horizontal gutters 1*b* and are in contact with the bottom of panel 5. Rain water leaking in through a broken seal 7 or between panels 5 will drain to the outside of the building through baffle strips 12 located along weep holes 20*a* spaced along the head extrusion 1.

Similar baffles are supported on gutter 14*c* (FIG. 3) which drain water through the baffles and through weep holes 20*a* in the sill extrusion 14. Projection 14*d* from the gutter-like horizontal member 14*c* engages projections 15*a* on clip 15 to support window 8, 8 having perimetrical seal 9. A gasket 18 and wedge 17, preferably of neoprene, are provided to thermally isolate window pane 8, from the metal sill. Caulk 19 seals insulating wall 5 to the sill extrusion 14.

Figure 4:
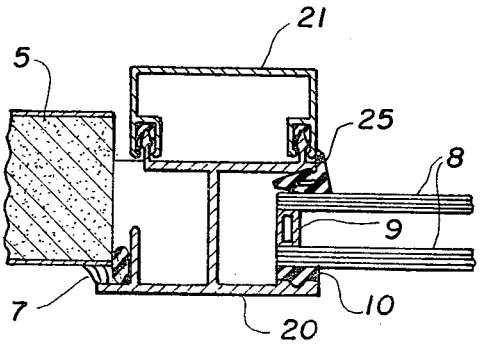
FIG. 4 is a fragmentary cross-sectional view of a jamb extrusion and trim.

FIG. 4 shows a jamb trim 21 thermally insulated from the jamb extrusion 20 and shows elastic insulating strips 10 and 25, preferably of neoprene, thermally sealing the window panes 8 from the jamb 20, 21. These are the same as gasket 18 and wedge 17 referred to in the previous paragraph.

Figure 5:
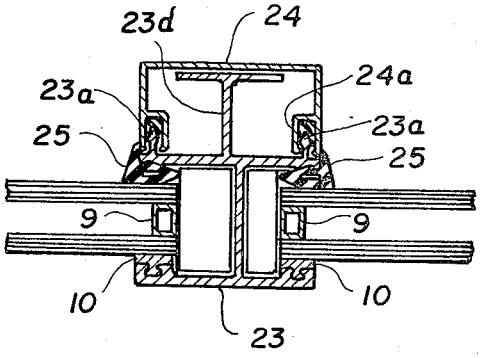
FIG. 5 is a cross-sectional view taken along line V—V of FIG. 1 showing a mullion extrusion and trim.

FIG. 5 shows a flange 23*d* of T cross section to provide extra strength and which is closely adjacent to mullion trim 24. It also shows mullion extrusion 23 thermally isolated from the window by insulating strips 25 of wedge cross section,—also mullion trim 21 isolated by short insulator pieces surrounding and snap fastened to arrowhead projections 23*a*.

Figure 7:
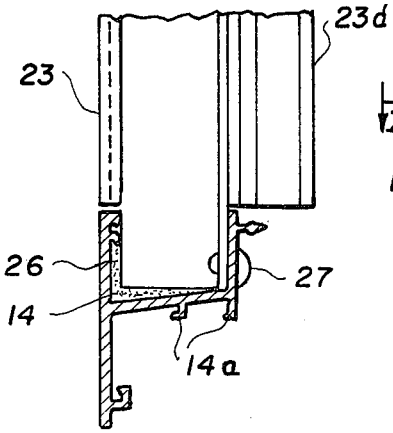
FIG. 7 is a side view, partly in cross section, taken along line VII—VII of FIG. 1 showing how the mullion is joined and sealed to the sill extrusion.

FIG. 7 shows how the sill extrusion 14 is connected by self tapping screws 27 to the mullion extrusion 23.

Figure 8:
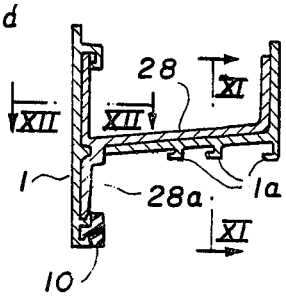
FIG. 8 is a vertical cross-sectional view taken at the jointure between two adjoining ladder-like members showing the splice at the head.

FIG. 8 shows how the head extrusion 1 is spliced by means of splice plate 28, 28*a* to another length of head extrusion.

Figure 9:
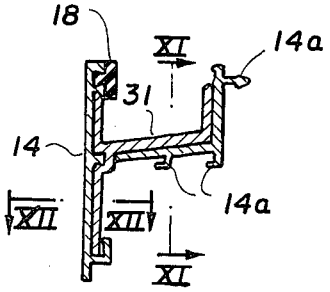
FIG. 9 is a vertical cross-sectional view taken at the jointure between two adjoining ladder-like members showing the splice at the sill.

Similarly, FIG. 9 shows how the sill extrusion 14 is spliced by splice plate 31 to another length of sill.

Figure 10:
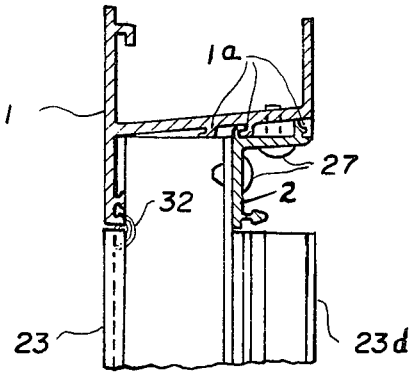
FIG. 10 is a vertical cross-sectional view taken along line X—X of FIG. 1 showing how the head is joined to the mullion.

FIG. 10 shows how the mullion 23, 23*d* is fastened through head clip 2 by self-tapping screws 27 to the head extrusion 1.

Figure 11:
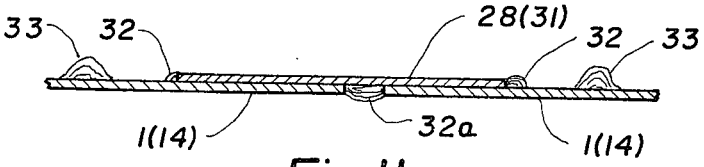
FIG. 11 is a cross-sectional view taken along line XI—XI of FIG. 8 illustrating a splice.
Figure 12:
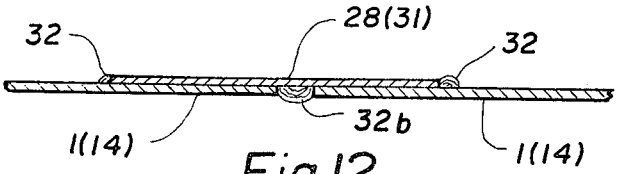
FIG. 12 is a cross-sectional view taken along line XII—XII of FIG. 8 showing another splice.

FIGS. 11 and 12 are cross-sectional views of FIGS. 8 and 9 illustrating how a lap is provided for splicing the parts together. Numeral 32 shows a factory seal (curing sealant) and numerals 33 show a caulk dam on both sides of the splice plate. Numeral 32 shows a seal and 32*b* shows a seal and bond breaker.

Figure 13:
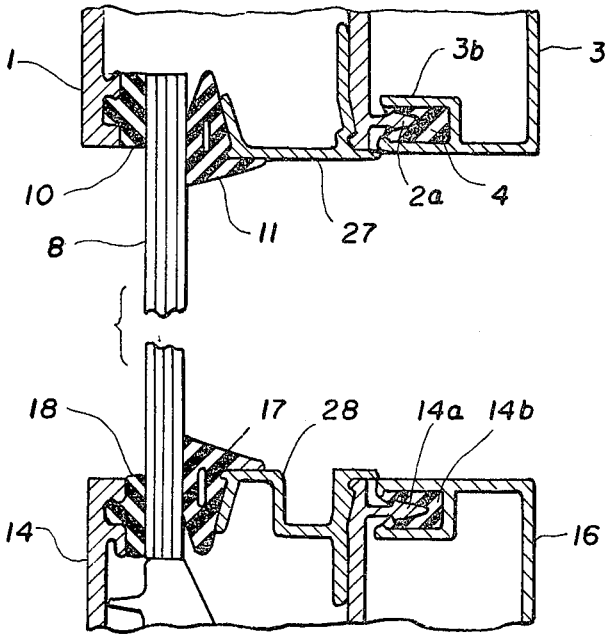
FIG. 13 is a fragmentary, vertical cross-sectional view of the head and sill showing how a single window may be substituted for a double window.

FIG. 13 shows a modification of FIGS. 2 and 3 showing additional adapters 27*a* and 29 to accomodate a single pane instead of a double pane window.

Thus it will be seen that I have provided a highly efficient and integral window and wall system for easily and quickly erecting industrial and other buildings in a minimum of time and with the greatest of ease and which system provides heat isolation of the inner metal walls from the outer metal walls so as to prevent condensation on the inner metal walls; also which enables easy adjustment, for installing and glazing or reglazing either single or double pane windows from inside the building and wherein a continuous gutter system is provided which drains not only a particular window, but the wall panels extending above the window so as to completely drain the entire wall assembly and avoid the forming of pockets therein,—also which provides baffles and weep holes interiorly which eliminate the necessity for outside hoods to prevent entry of gusts of wind or water.

While I have illustrated and described several embodiments of my invention, it will be understood that these are by way of illustration only and that various changes and modifications may be contemplated in my invention and within the scope of the following claims.

I claim:

1. A window and wall system comprising a horizontally extending, ladder-like outer metal member and a correspondingly shaped ladder-like inner metal member spaced therefrom in confronting relationship, the upper longitudinal portions of said ladder-like metal members comprising head portions, the lower longitudinal portions comprising sill portions, and the vertically extending cross portions bridging said head and sill portions comprising mullion portions, upper insulating wall panel sandwiched between the head portions and lower insulating wall panel sandwiched between the sill portions; the head portion of said ladder-like outer metal member having an inner wall, an integral flange extending from an intermediate portion of said inner wall in a slight angularly upward direction and terminating in a vertically upwardly extending support for the inner lower edge of said insulating wall panels and to form gutters for water drainage, the sill portion of said ladder-like outer metal member having an inner wall, an integral flange emerging from an intermediate portion of said last mentioned inner wall in a slight angularly upward direction and terminating in a vertically upwardly extending support, a plurality of windows sandwiched between said inner metal wall of said ladder-like outer metal member and said vertically upwardly extending support of said outer and inner metal walls in the openings thereof, thermal insulation between said last mentioned support and the lower edges of said windows and between said ladder-like outer and inner metal members to prevent conduction of cold or heat there between and bridging means for bridging together end-to-end lengths of said ladder-like outer and inner metal members to provide an extended horizontal row of windows separated by said mullions.

2. A window and wall system as recited in claim 1 wherein weep holes are provided in said outer ladder-like metal member slightly above the level of said flanges for draining water to the outer surfaces of said ladder-like outer metal member.

3. A window and wall system as recited in claim 2 wherein sponge-like baffles are supported on said flanges adjacent said weep-holes to protect against incoming gusts of wind or rain.

4. A window and wall system as recited in claim 2 wherein said bridging means comprises a splicing plate in each of said head and sill portions, each plate having a vertical flange engageable with the inner wall of said ladder-like outer metal member and having an interconnecting substantially horizontal flange superimposed on and bridging together end-to-end lengths of said ladder-like outer and inner metal members.

5. A window and wall system as recited in claim 2 wherein porous blocks of material are provided on said integral flanges adjacent said weep holes in contact with the bottoms of the upper insulating wall panels.

6. A window and wall system as recited in claim 5 together with a vertical flange portion extending into and connected to said head and sill portions.

7. A window and wall system as recited in claim 1 together with head adapter means in said head portions and sill adapter means in said sill portions to accommodate single pane windows.

8. A window and wall system as recited in claim 1 together with a glazing bead interposed between said ladder-like outer and inner metal members in the head portion and a clip interposed therebetween in the sill portion and wherein a plurality of projections extends downwardly from the bottom surfaces of said flanges for engagement with an upwardly extending projection of said glazing bead and clip.

9. A window and wall system as recited in claim 1 together with shims supported against said first mentioned vertically upwardly extending support.

10. A window and wall system as recited in claim 1 wherein said cross portions of said ladder-like outer and inner metal members sandwich, through thermal insulators, the vertical edges of said windows and serve as mullions.

11. A window and wall system as recited in claim 1 wherein a vertical flange is provided on the inside of said cross portions, elastic heat insulating strips sandwiched between said vertical flange and the inner edges of said windows, and elastic heat insulating strips sandwiched between the outer edges of said windows and the inner vertical edges of said cross portions.

12. A window and wall system as recited in claim 1 together with heat isolating elements sandwiched between said vertical flange and the inner metal cross portions.

13. A window and wall system as recited in claim 1 wherein thermal insulation is in the form of elastic strips connect one horizontal edge of the inner metal member to said head and sill portions, and snap, heat insulating locking strips connecting the other horizontal edge of the inner metal member to said head and sill portions, to facilitate glazing and reglazing of said window units from the inside of the building.

* * * * *